United States Patent [19]

Laroche

[11] 4,298,236

[45] Nov. 3, 1981

[54] SAFETY LOCK SYSTEM FOR VERTICALLY STACKED STORAGE ELEMENTS

[75] Inventor: Robert N. Laroche, St. Julie, Canada

[73] Assignee: Artopex Inc., Laval, Canada

[21] Appl. No.: 168,738

[22] Filed: Jul. 14, 1980

[51] Int. Cl.[3] ..... E05B 65/46; E05C 15/04

[52] U.S. Cl. ..... 312/215; 312/216; 312/217; 312/221; 312/222

[58] Field of Search ..... 312/215, 216, 217, 218, 312/219, 220, 221, 222, 107.5; 292/4, 5

[56] References Cited

U.S. PATENT DOCUMENTS

| | | | |
|---|---|---|---|
| 497,406 | 5/1893 | Du Bois et al. | 312/221 |
| 2,240,067 | 4/1941 | Bolesky et al. | 312/221 |
| 2,886,392 | 5/1959 | Stegmaier | 312/217 |
| 3,323,849 | 6/1967 | Stark | 312/221 |
| 3,404,929 | 10/1968 | Wright et al. | 312/222 |
| 3,622,216 | 11/1971 | Haunost | 312/219 |
| 3,900,236 | 8/1975 | Goulish et al. | 312/217 |
| 3,909,090 | 9/1975 | Breckner et al. | 312/217 |

*Primary Examiner*—Victor N. Sakran
*Attorney, Agent, or Firm*—Alan Swabey; Robert Mitchell; Guy J. Houle

[57] ABSTRACT

A safety lock system for vertically stacked slideably retained storage elements, such as file drawers. The system comprises one or more locking bars vertically slideably retained in alignment in a vertical support guide channel. Two or more cam elements are pivotally secured on a respective fixed pivot axis to the support guide channel adjacent an opposed end of each of the locking bars. Each of the cam elements have a cam portion retained in planar alignment with the locking bars and an activating arm portion for rotating the cam portion about the fixed pivot axis. A displaceable space is provided below each cam element portion defined between one of the locking bar opposed ends and the cam portion. An engaging member is secured to one or more of the storage elements. The engaging member engages and displaces the activating arm portion of an associated cam element by predetermined displacement of a storage element having the engaging member to cause rotation of the associated cam portion to slidingly displace the locking bars thereabove through the displaceable space in immovable contact with their associated cam elements and arrest sliding displacement of the locking bars therebelow to maintain them in immovable contact with their associated cam elements to thereby immobilize all other cam elements against rotational displacement and thereby prevent slideable displacement of all other of the storage elements having an engaging member.

14 Claims, 10 Drawing Figures

SAFETY LOCK SYSTEM FOR VERTICALLY STACKED STORAGE ELEMENTS

BACKGROUND OF INVENTION (a) Field of the Invention

The present invention relates to an improved safety lock system having movable locking bars and fixed pivotal cams whereby predetermined ones of a plurality of vertically slideable storage elements are locked when a selected one of the storage elements is displaced a predetermined distance.

(b) Description of Prior Art

Various interlock systems are known for use with filing cabinets wherein drawers may be locked or prevented from opening when a first drawer is withdrawn from the cabinet. An example of this prior art is a file interlock system as shown in U.S. Pat. No. 3,900,236 issued Aug. 19, 1975 and wherein there is shown a system comprising lock bars having cam members secured thereto and wherein the lock bars are displaceable to an immovable position against a cabinet wall to prevent withdrawing any file drawer of the cabinet once a file drawer is opened.

SUMMARY OF THE INVENTION

The present invention relates to an improvement of such system whereby it may be possible to bypass particular drawers in a filing cabinet or other type system having slideable storage elements and wherein the lock system may be modified during use to remove the interlock from particular ones of the storage elements. It is also desired to provide such a locking system which operates on a different principle whereby the system is more economical to construct and assemble. It is also desirable to have a locking system which need not be restricted for use in a cabinet housing but which may be adapted to a plurality of vertically slideable storage elements mounted in an open frame. Furthermore, it is desirable to have a system which would prevent two drawers from being withdrawn simultaneously.

Accordingly, a feature of the present invention is to provide an improved safety lock system wherein selected ones of a plurality of vertically slideable storage elements are arrested when a particular one of the storage elements is displaced a predetermined distance by arresting cam elements and movable locking bars disposed between the cam elements.

A further feature of the present invention is to provide a safety lock system for use with a plurality of vertically stacked slideably retained storage elements of different sizes and wherein selected ones of the storage elements, at random, may be bypassed from the lock system.

According to a further feature of the present invention, there is provided a safety lock system for use in a filing cabinet which prevents two drawers from being withdrawn simultaneously.

Another feature of the present invention is to provide a safety lock system which is economical to produce and easy to assemble.

According to the above features, from a broad aspect, the present invention provides a safety lock system for vertically stacked slideably retained storage elements, said system comprising one or more locking bars vertically slideably retained in alignment in vertical support guide means, two or more cam elements pivotally secured on a respective fixed pivot axis to said support guide means adjacent an opposed end of each said locking bars, each said cam elements having a cam portion retained in planar alignment with said locking bars and an activating arm portion for rotating said cam portion about said fixed pivot axis, a displaceable space below each cam element portion defined between one of said locking bar opposed ends and said cam portion, an engaging member secured to one or more of said storage elements to engage and displace said activating arm portion of an associated cam element by predetermined displcement of a storage element having said engaging member to cause rotation of said associated cam portion to slidingly displace said locking bars thereabove through said displaceable space in immovable contact with their associated cam elements and arrest sliding displacement of said locking bars therebelow to maintain them in immovable contact with their associated cam elements to thereby immobilize all other cam elements against rotation displacement and thereby prevent slideable displacement of all other of said storage elements having an engaging member.

According to a further broad aspect of the present invention, there is provided a method of locking predetermined ones of a plurality of vertically slideable storage elements when a selected one of said storage elements is displaced a predetermined distance, said method comprising (i) securing a lock support means vertically adjacent a displaceable side wall of said stacked storage elements; (ii) providing sliding bars for slideable displacement in alignment in said support means; (iii) providing cam elements pivotally secured on a respective fixed pivot axis to said support means adjacent opposed ends of said sliding bars; (iv) rotating a selected one of said cam elements by predetermined sliding displacement of a selected one of said storage elements to cause sliding displacement of said locking bars above said rotated selected cam element, and (v) arresting said locking bars below said selected one of said storage elements by said rotated cam element to arrest all other cam elements to thereby prevent slideable displacement of the remainder of said predetermined ones of said plurality of storage elements.

BRIEF DESCRIPTION OF DRAWINGS

A preferred embodiment of the present invention will now be described with reference to the example thereof illustrated in the accompanying drawings in which.

DESCRIPTION OF PREFERRED EMBODIMENTS

Figure 6:
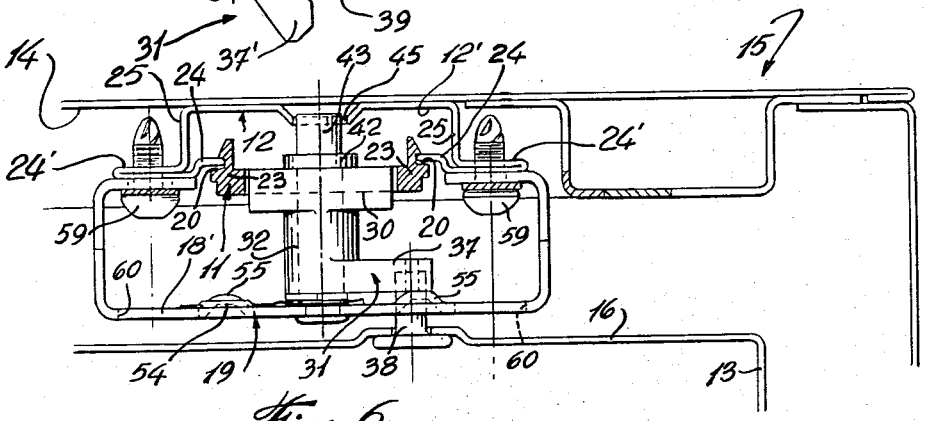
FIG. 6 is a top section view showing the cam element mounted in a guide channel secured to a file cabinet wall and showing the position of the engaging pin secured to a file drawer.

Referring now to the drawings and more particularly to FIGS. 1 and 2A to 2C, there is shown generally at 10, the safety lock system of the present invention. The safety lock system comprises one or more locking bars 11 vertically slideably retained in planar alignment in a vertical support guide means, herein constituted by a support channel 12. The support channel 12 is vertically securable to a support frame, as shown in FIG. 6, to the inner side wall 14 of a filing cabinet 15 and disposed adjacent a side wall 16 of a plurality of vertically stacked slideably retained storage elements 13, herein file drawers displaceable on guide rails.

Two or more cam elements 17 are pivotally secured on a respective fixed pivot pin 18 secured in the guide channel 12 and extending between the back wall 12' of the channel 12 and a front wall 18' of a support plate 19 removably secured in front of the guide channel 12.

As shown more clearly in FIGS. 2A to 2C and FIG. 6, the locking bars 11 are elongated straight flat members having opposed elongated edge grooves 20 and the opposed ends 21 each have a cam engaging surface 22 and a locking bar support surface 23. Locking bars 11 are slidingly retained and displaceable within the guide channel 12 by means of side rails 24 secured to each opposed side wall 25 and formed integral with the back wall 12' of the guide channel. Thus, the locking bars 11 can move up and down along the side rails 24 and are maintained in a common plane.

The cam engaging surface 22 is a concave end cavity in each of the flat opposed end walls 21 of the locking bars. The cavity 22 has opposed sloping walls 26 terminating at a central apex point 27. The locking bar support surface 23 is constituted by an end arm 28 provided on opposed sides of the concave end cavity or cam engaging support surface 22. The end arms 28 of the locking bars abut or rest on the arms of the adjacent locking bar and the cam element 17 is disposed between the locking bars in the space delineated between opposed concave end cavities 22.

Referring now to FIGS. 3 to 6, the construction of the cam element 17 will now be described. As shown more clearly in FIGS. 3 and 5, the cam element 17 is an integrally formed part comprising a cam portion 30 and an activating arm portion 31 and both these portions are spaced apart by a connecting body 32 having a through bore 33 extending therethrough to receive the pivot pin 18 therethrough.

The cam portion 30 is a dual cam portion comprising diametrically opposed shoulder sections 34 lying in a horizontal plane 35 when the cam element 17 is in its non-activated position, that is to say, its associated storage element 13 is not displaced or withdrawn from the stack. The cam portion 30 is substantially of an elliptical shape and has a flat contour side wall 36 whereby to provide flush engagement with the flat wall of the cam engaging surface or cavity 22 of the locking bars 11.

Figure 4:
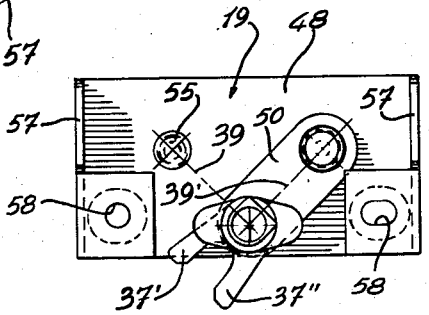
FIG. 4 shows the cam element assembled on its support plate.
Figure 5:
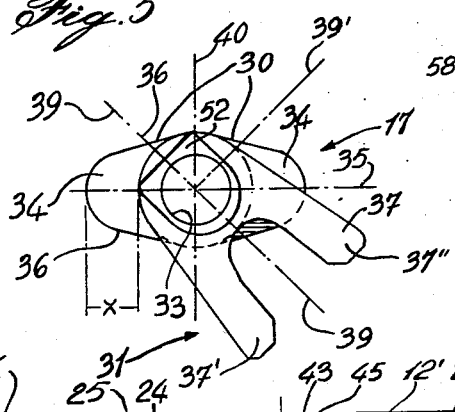
FIG. 5 is a plan view showing the construction of a cam element.

As shown in FIG. 5, the activating arm portion 31 is a fork shaped element having opposed arms 37 which are engageable by an engaging member, herein an engaging pin 38 (see FIG. 6) secured to an associated one of a plurality of storage elements 13. The central longitudinal axis 39 of the activating arm portion 31 extends at 45° from the central longitudinal axis 35 of the cam portion 30. Therefore, with the axis 35 disposed horizontally, as the engaging pin 38 is displaced in the plane of the sliding storage element 13, the pin 38 will rotate the activating arm portion 31 from the position shown in FIG. 5 to a position where its central longitudinal axis 39 lies along the axis 39' (as shown in FIG. 4) resulting in a 90° displacement thereof. This displacement causes the cam portion 30 to rotate whereby its central longitudinal axis 35 now lies on the vertical axis 40. The operation of the cam and the locking bars 11 will be described later.

Figure 3:
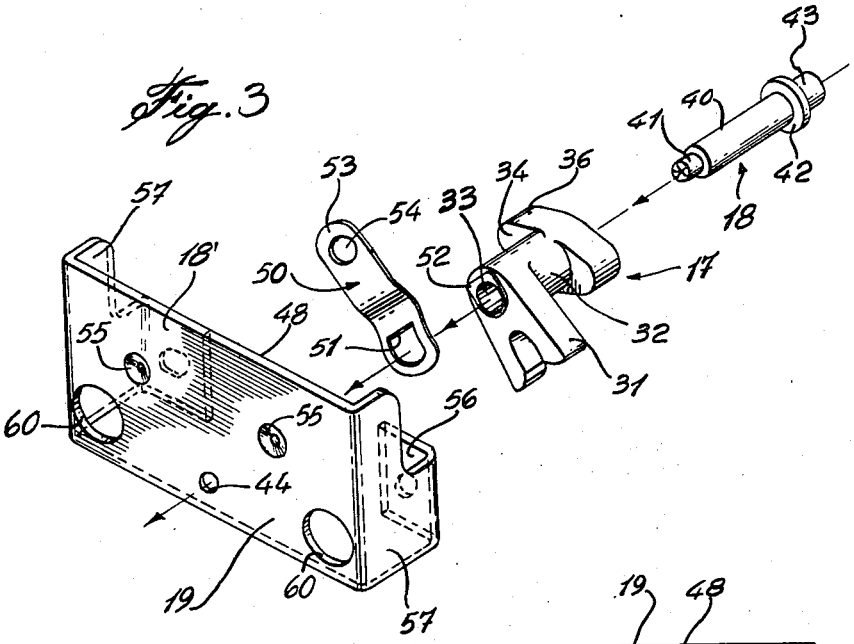
FIG. 3 is an exploded view showing the assembly of the cam elements.

As previously described, the cam element 17 is rotatably supported on a pivot pin 18 which is secured between the back wall 12' of the guide channel 12 and the front wall 18' of the support plate 19. As shown in FIG. 3, the pivot pin 18 is provided with a cylindrical main body portion 40 having an attachment end portion 41. A locating sleeve 42 is provided about the main body portion 40 adjacent a locating end portion 43 of the main body portion 40. The locating sleeve 42 provides retention of the cam element 17 for precise positioning of the pivot pin 18 within its through bore 33. The pivot pin extends between the back wall 12' of the guide channel 12 and the front wall 18' of the support plate 19. The attachment end 41 of the pin extends through a securement hole 44 provided in the front wall 18' of the support plate 19 and is rivetted therein. The locating end portion 43 of the pin is received freely in a support hole 45 formed in the back wall 12' of the guide channel 12 whereby the plate 19 is removable from the channel 12.

Referring again to FIG. 3, there is shown the construction of a retention spring 50 which is secured intermediate the end surface 49 of the activating arm portion 31 of the cam 17 and the inner surface 48 of the end wall 18' of the support plate 19. The retention spring 50 has a curvate shape whereby to maintain pressure between the end surface 49 of the cam 17 and the support plate 19 and therefore acts as a pressure washer. However, the main purpose of the spring 50 is to maintain the actuating arm portions 31 of the cam elements in their respective non-actuated or actuated positions, that is to say, along the axes 39 or 39' of FIG. 5, when its associated storage element 13 is fully closed or displaced a predetermined distance.

The spring 50 is provided with a contoured hole 51 adjacent a lower end thereof whereby it can be localized within indexing tab 52 formed about the through bore 33 on the end surface 49 of the cam element 17. The localizing contour hole 51 aligns the longitudinal axis of the spring 50 co-extensive with the longitudinal central axis 39 of the activating arm portion 31. The free end 53 of the spring 50 is provided with engageable means, herein a hole formed as a concave depression 54 to frictionally engage with two holding means, herein being convex punch tabs 55 provided in the inner surface 48 of the support plate 19 and positioned such as to retain the spring 50 with its central longitudinal axis aligned 90° apart and coinciding with the axes 39 and 39' as shown in FIG. 5 whereby to maintain frictional retention of the cam element 17 with the cam portion 30 thereof extending in the horizontal plane 35 (see FIG. 5) and in the vertical plane 40 when displaced thereto by the engaging pin 38.

As shown in FIGS. 3 and 4, the support plate 19 is provided with opposed securement wings 56 disposed parallel to the front wall 18' and formed integral with transverse side walls 57. A hole 58 is provided in each of the wings 56 to receive a securement screw 59 therethrough to secure the support plate 19 to the attachment flanges 24' of the guide channel 12 (see FIG. 6) and formed integral with the slide rails 24. Access to the securement screws 59 is provided through apertures 60 axially aligned with the holes 58 and formed in the front wall 18'.

Figure 7A:
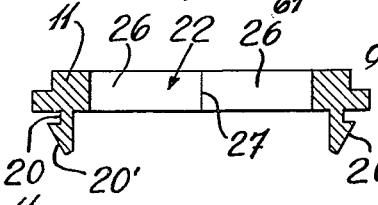
FIGS. 7A and 7B are end views showing the end of the locking bar in section and in fragmented plan view.
Figure 7B:
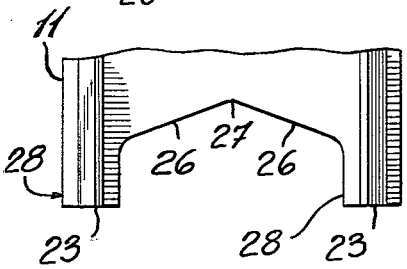
Figure 2C:
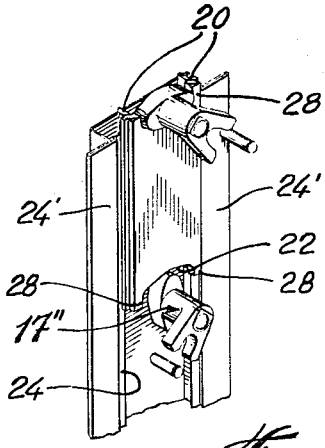

Referring to all the drawings, and more particularly to FIGS. 1 and 2A to 2C, the operation of the safety lock system will now be described. In the assembly of the safety lock system, a bottom cam element, such as shown at 17' in FIG. 2A, is secured to the guide channel 12. Thereafter, a first locking bar 11' is shaped fitted into the channel with the cam engaging cavity 22 resting on the horizontally disposed cam portion 30 of the cam element 17'. As shown in FIGS. 7A and 7B, each locking bar is provided with flexible inner elongated retaining ridges 20' which flex inwardly to locate the opposed side rails in a respective one of the opposed elongated edge groups 20 for sliding retention of the locking bars therewith. Thereafter, a second lowermost cam element 17" is secured to the guide channel and a second lowermost locking bar 11 positioned thereover and this sequence continues along the guide channel 12 up to the predetermined number of cam elements required to lock a predetermined number of vertically stacked slideably retained storage elements 13.

Figure 1:
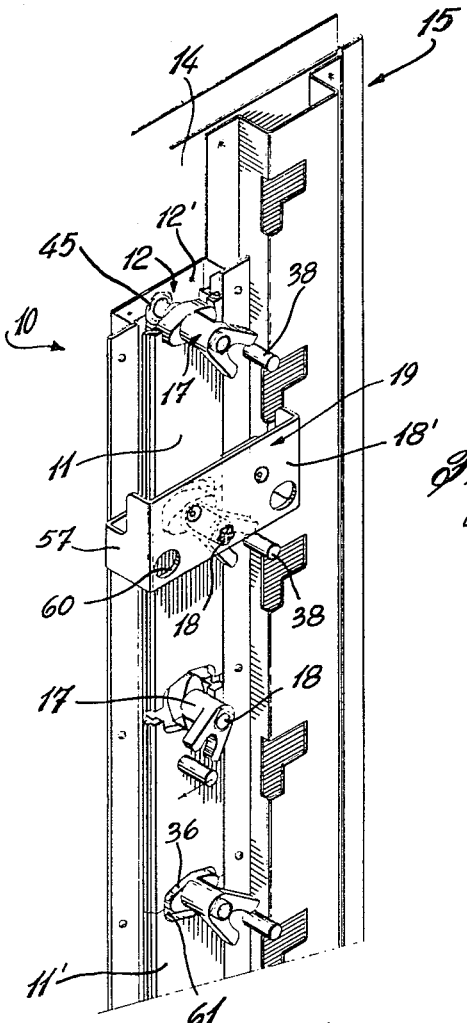
FIG. 1 is a perspective fragmented view of the safety lock system illustrating the operation thereof.
Figure 2A:
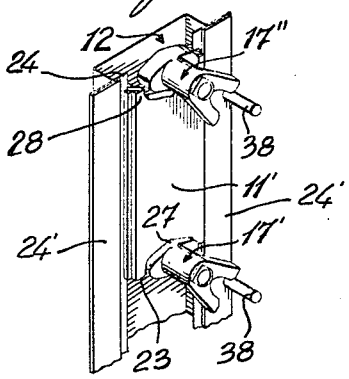
FIGS. 2A to 2C are fragmented perspective views illustrating the operation of the cam elements and locking bars showing the displacement of the locking bars above and below a rotated cam element.

As shown at the bottom of FIG. 1, the opposed ends 21 of the end arms 28 are in abutment with each other and are very closely spaced to each other when the locking system is assembled and a displaceable space 61 is formed between the contour side wall 36 of the cam portion 30 and the flat wall of the cam engaging surface 22 of the locking bar positioned thereunder. The displacement space 60 is spaced from the contour side wall 36 of the cam portion 30 a distance sufficient to permit the cam portion 30 to be displaced to its vertical position on the vertical axis 40 and it is equal to the distance X as shown in FIG. 5.

Figure 2B:
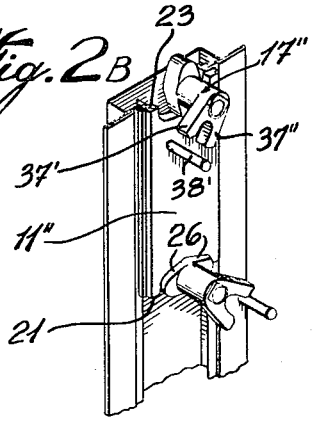

With all of the storage elements 13 having engagement pin 38 secured thereto resting in their stored position, all of the engaging pins 38 are resting in the position as shown in FIG. 2A and the safety lock system is inactive. As soon as one of the storage elements 13 is pulled outwardly a predetermined distance, its associated engaging pin, such as 38' in FIG. 2B, will be displaced horizontally with respect to the cam element and engage the arm 37' of the activating arm portion 31 causing the cam portion of the cam element 17" to rotate 90° and locate itself on the vertical axis 40. This rotating movement of the cam portion 30 causes all of the uppermost locking bars 11 to move upwardly into the displaceable space 60 until they abut or very closely space to the side wall 36 of the cam elements 17 located thereabove. Thus, the locking bars 11 above the rotated cam 17" and the cam elements thereabove are in immovable position. The locking bars below the rotated cam element 17", for example locking bar 11" as shown in FIG. 2B, cannot be displaced as its cam engaging support cavity 22 is resting onto the side wall of the cam portion 30 of the cam element therebelow. Thus, all of the cam elements therebelow and locking bars therebelow are arrested from further movement through the cam portion 30 of the rotated cam element 17" and the entire cam and locking bar assembly is locked through that rotated cam element 17". Therefore, no other storage elements 13 having engagement pins 38 thereon can be displaced as the engaging pin 38 will be arrested by the actuating arm portion 31 of the other cams which are all locked or arrested by the locking bars. When the displaced storage element 13 is slid back into its storage position, its engaging pin 38 will engage with the arm 37" (see FIG. 2B) and displace the actuating arm portion 31 back to its inactive position on the axis 39 (see FIGS. 4 and 5). Thus, the locking bars above the rotated cam element 17 will drop to its unlocked position, that is, each bar will rest on their lower ends on their associated cams 17 and the lowermost bars will not move. All of the cam elements are therefore in their inactive position with their cam portions 30 extending horizontally.

As previously described, it is not possible with the locking system of the present invention to withdraw two slideable storage retaining elements 13 simultaneously. More precisely, referring to FIG. 2A, it can be seen that if two of the sliding elements were withdrawn simultaneously, each of their engaging pins 38 would abut against one of the arms 37 of their respective cam elements 17. This would start a clockwise rotation of the opposed shoulder sections 34 with the lower cam element 17' causing the locking bar 11' to move upwardly while simultaneously the upper cam element 17" would apply downward pressure on the upper portion of the locking bar 11'. These opposed forces would cancel out the movement of the locking bar thereby preventing the drawers from being withdrawn. In a situation where a drawer may be only slightly open with its engaging pin 38 positioned intermediate the opposed arms 37' and 37" of the activating arm portion 31, and a further drawer is pulled out, the force exerted on the locking bars will cause the shoulder sections 34 of the cam element slightly displaced to reassume its horizontal position whereby the activating arm portion 31 will retract the drawer into a fully closed position.

It is within the ambit of the present invention to cover any obvious modifications of the preferred embodiment thereof disclosed hereinabove, provided such modifications fall within the scope of the appended claims.

I claim:

1. A safety lock system for vertically stacked slideably retained storage elements, said system comprising one or more locking bars vertically slideably retained in alignment in vertical support guide means, two or more cam elements pivotally secured on a respective fixed pivot axis to said support guide means adjacent an opposed end of each said locking bars, each said cam elements having a cam portion retained in planar alignment with said locking bars and an activating arm portion for rotating said cam portion about said fixed pivot axis, a displaceable space below each cam element portion defined between one of said locking bar opposed ends and said cam portion, an engaging member secured to one or more of said storage elements to engage and displace said activating arm portion of an associated cam element by predetermined displacement of a storage element having said engaging member to cause rotation of said associated cam portion to slidingly displace said locking bars thereabove through said displaceable space in immovable contact with their associated cam elements and arrest sliding displacement of said locking bars therebelow to maintain them in immovable contact with their associated cam elements to thereby immobilize all other cam elements against rotational displacement and thereby prevent slideable displacement of all other of said storage elements having an engaging member.

2. A safety lock system as claimed in claim 1 wherein said cam portion is a dual cam portion comprising diametrically opposed shoulder sections one to each side of said pivot axis, said shoulder sections lying in a horizontal plane when its associated storage element is in a closed position and being displaced to a vertical plane when its said associated storage element is withdrawn a predetermined distance.

3. A safety lock system as claimed in claim 2 wherein said locking bar opposed ends each have a cam engaging surface and a locking bar support surface; when all said storage elements having said engaging member are in said closed position and said cam elements are positioned in said horizontal plane, said locking bars rest on a cam element adjacent its lower opposed end and being spaced below a cam element adjacent its upper opposed end a distance constituting said activating displacement space which is approximately equal to the said displacement caused by one of said cam elements when positioned in a vertical plane.

4. A safety lock system as claimed in claim 3 wherein said cam portion is of substantially elliptical shape and a flat contour side wall, said activating arm portion being a fork-shaped member having opposed arms, each said opposed arms being engageable by said engaging member of an associated storage element during predetermined displacement of said storage element to an open and to a closed position, respectively.

5. A safety lock system as claimed in claim 3 wherein said cam engaging surface is a concave end cavity in each flat opposed end wall of each said locking bars, said cavity having opposed sloping walls terminating at a central apex point, said locking bar support surface being constituted by an end arm on opposed sides of said concave end cavity, said end arms of said locking bars displaced above said rotated cam element abutting one another while said end arms of said locking bars immobilized said rotated cam element are each spaced by said activating displacement distance.

6. A safety lock system as claimed in claim 3 wherein said vertical support guide means is a support channel vertically securable adjacent a side wall of said stacked storage elements.

7. A safety lock system as claimed in claim 3 wherein said locking bars are elongated straight members having opposed elongated grooves; said support channel having a back wall, opposed side walls and side rails in planar alignment on a respective free end of said side walls; said side rails being received in a respective one of said grooves of said locking bars.

8. A safety lock system as claimed in claim 3 wherein said cam element is supported on a pivot pin rotatably supported at one end in a bore in a back wall of said support channel and at an opposed end being secured to a support plate detachably securable over said support channel.

9. A safety lock system as claimed in claim 8 wherein said cam element cam portion and activating arm portion are integrally formed and spaced apart by a connecting body having a through bore to receive said pivot pin therethrough.

10. A safety lock system as claimed in claim 9 wherein there is further provided a retention spring for maintaining said cam portion in said horizontal and vertical plane when displaced thereto by said displacement of said activating arm portion by said engaging member.

11. A safety lock system as claimed in claim 10 wherein an indexing tab is formed about an outer face of said activating arm portion about said through bore, said retention spring having a contoured hole for localized connection to said activating arm portion and extending coextensive with the longitudinal center axis of said activating arm portion, engageable means at a free end of said spring, a first and second holding means to retain said spring with its central long axis aligned 90° apart to maintain frictional retention of said cam portion in said horizontal and vertical plane when displaced thereto.

12. A safety lock system as claimed in claim 1 wherein said slideable storage elements are file drawers, said drawers being secured on guide rails in a file cabinet having opposed side walls, a back wall and a top and bottom wall, said lock support channel being secured vertically to one of said cabinet side walls.

13. A safety lock system as claimed in claim 1 wherein said engaging member is a pin secured to said one or more storage elements and extending outwardly of said side wall thereof in alignment to engage said activating arm portion of said cam elements.

14. A method of locking predetermined ones of a plurality of vertically slideable storage elements when a selected one of said storage elements is displaced a predetermined distance, said method comprising (i) securing a lock support means vertically adjacent a displaceable side wall of said stacked storage elements, (ii) providing sliding bars for slideable displacement in alignment in said support means, (iii) providing cam elements pivotally secured on a respective fixed pivot axis to said support means adjacent opposed ends of said sliding bars, (iv) rotating a selected one of said cam elements by predetermined sliding displacement of a selected one of said storage elements to cause sliding displacement of said locking bars above said rotated selected cam element, and (v) arresting said locking bars below said selected one of said storage elements by said rotated cam element to arrest all other cam elements to thereby prevent slideable displacement of the remainder of said predetermined ones of said plurality of storage elements.

* * * * *